US005934263A

United States Patent [19]

Russ et al.

[11] Patent Number: 5,934,263

[45] Date of Patent: Aug. 10, 1999

[54] INTERNAL COMBUSTION ENGINE WITH CAMSHAFT PHASE SHIFTING AND INTERNAL EGR

[75] Inventors: Stephen George Russ, Canton; William Francis Stockhausen, Northville, both of Mich.

[73] Assignee: Ford Global Technologies, Inc., Dearborn, Mich.

[21] Appl. No.: 08/890,506

[22] Filed: Jul. 9, 1997

[51] Int. Cl.[6] ..... F02D 41/18; F02B 47/08

[52] U.S. Cl. ..... 123/698; 123/568.14

[58] Field of Search ..... 123/568.14, 198 F, 123/698, 704

[56] References Cited

U.S. PATENT DOCUMENTS

| | | | |
|---|---|---|---|
| 4,182,289 | 1/1980 | Nakajima et al. | 123/90.16 |
| 4,357,917 | 11/1982 | Aoyama | 123/90.16 |
| 4,722,315 | 2/1988 | Pickel | 123/568.14 |
| 4,942,860 | 7/1990 | Chujo et al. | 123/704 |
| 5,226,401 | 7/1993 | Clarke et al. | 123/568.14 |
| 5,404,844 | 4/1995 | Schechter | 123/90.12 |
| 5,467,748 | 11/1995 | Stockhausen | 123/198 F |
| 5,531,193 | 7/1996 | Nakamura | 123/90.15 |
| 5,562,085 | 10/1996 | Kosuda et al. | 123/568 |
| 5,642,703 | 7/1997 | Stockhausen et al. | 123/198 F |

FOREIGN PATENT DOCUMENTS

| | | |
|---|---|---|
| 2838683 | 3/1980 | Germany . |
| 58-14464 | 8/1983 | Japan . |
| 1372081 A1 | 7/1988 | Russian Federation . |

OTHER PUBLICATIONS

960584; T. G. Leone, E. J. Christenson and R. A. Stein; Comparison of Variable Camshaft Timing Strategies at Part Load, 1996.

*Primary Examiner*—Andrew M. Dolinar
*Assistant Examiner*—Arnold Castro
*Attorney, Agent, or Firm*—Donald A. Wilkinson

[57] ABSTRACT

A four-stroke cycle, multi-cylinder reciprocating internal combustion engine (10) has a camshaft phaser (34) for adjusting the rotational position of the intake and exhaust camshafts (25, 26) with respect to the rotational position of the crankshaft (12) so that some of the cylinders (8) of the engine (10) may be deactivated. A common intake plenum (38) provides intake air to each of the cylinders (8) during normal engine operation, while an exhaust system (40) receives exhaust gasses from both the deactivatable cylinders (8*a*) as well as the other cylinders (8*b*). The cam phaser (34) adjusts the camshaft positions during cylinder deactivation operation such that the deactivated cylinders (8*a*) pump exhaust gas through the deactivated cylinders (8*a*) into the common plenum (38), which is employed by the still active cylinders (8*b*) as EGR gas.

13 Claims, 2 Drawing Sheets

INTERNAL COMBUSTION ENGINE WITH CAMSHAFT PHASE SHIFTING AND INTERNAL EGR

FIELD OF THE INVENTION

The invention relates to a system and method for selectively deactivating at least some of the cylinders of a reciprocating internal combustion engine, and more particularly to a system and method for camshaft phase shifting of both the intake and exhaust valves to deactivate the cylinders while providing pumped exhaust gas recirculation (EGR) to the operating cylinders.

BACKGROUND OF THE INVENTION

Improved fuel economy may be realized by deactivating some of the cylinders of a multi-cylinder engine while the remaining cylinders carry the desired load. The primary reason for the fuel economy savings is that the working cylinders operate at a higher specific loading and therefore greater manifold pressure, which results in reduced intake stroke pumping work.

Multi-cylinder engines capable of cylinder deactivation have been produced. Typically, in the case of an in-line 4 cylinder engine, two cylinders are deactivated; in the case of a V6, three cylinders (one bank) are deactivated. In both cases, cylinder deactivation is effected by disabling both intake and exhaust valves by using individual valve controllers. This causes the piston to compress and expand the trapped mass within the cylinder each revolution of the crankshaft, thereby creating a gas spring. That is, the trapped mass of gas is alternatively compressed and expanded. Because the piston merely compresses and expands the gas which is trapped in the cylinder, the friction and thermodynamic losses are relatively small and the other engine cylinders, which are actually firing, may be operated with sufficiently greater efficiency so that the overall efficiency of the engine is improved. Neglecting heat transfer and piston ring blowby losses, the work done on compression is recovered on expansion so the only work expended is the friction for sliding the piston/ring assembly in the cylinder bore and the connecting rod bearings. And, the mechanical friction of the deactivated cylinders is reduced due to significantly lower peak cylinder pressures.

Unfortunately, prior art systems which disable both intake and exhaust valves of an engine's cylinders are quite expensive and are therefore unattractive, because vehicles in which fuel economy is most important are frequently sold in the lower price range, and are therefore unable to command a price sufficient to offset the cost of the added equipment.

A different solution to cylinder deactivation is to employ a dual equal variable displacement engine. This means that an actuator mechanism is employed to phase shift the intake and exhaust camshaft(s) equally on the cylinders to be deactivated. If the valves on the deactivated cylinders are controlled by two camshafts (DOHC), one for the exhausts and one for the intakes, then the phase shifter will have to control both equally with some means of interconnection. In essence, then, they will operate as a single overhead cam for phase shifting for cylinder deactivation. Assuming a single overhead cam (SOHC) on the cylinders to be deactivated, the camshaft is retarded (or alternatively can be advanced) approximately 90 to 100 degrees from standard timing using a wide-range phase shifter. The mass that is drawn into the cylinder in the later part of the intake stroke is pushed back out during the first part of the compression stroke. The exhaust gas that is pushed out during the last part of the exhaust stroke is drawn in during the first part of the intake stroke. Thus, there is no net mass flow through the deactivated cylinders and virtual elimination of net cycle pumping work, resulting in true cylinder deactivation.

Another concern arises with both of these cylinder deactivation systems mentioned, as well as others. With a cylinder deactivation engine system, oxides of nitrogen (NOx) during part load operation may be higher than is acceptable. In a conventional engine at part load, the pressure drop between the exhaust system (typically about atmospheric pressure) and the intake manifold (much below atmospheric pressure due to throttling) induces exhaust gas recirculation (EGR) to flow from the exhaust system through a control valve in an external EGR system into the intake manifold, thus effecting the control of NOx emissions.

However, with a variable displacement engine operating with some cylinders deactivated, the firing cylinders are carrying the load that normally would be carried by the whole engine. Thus, they are operating under much higher intake manifold absolute pressures due to the lesser amount of throttling. This higher pressure reduces the inducement of the EGR gasses to flow and further, as engine load increases, will cause no EGR flow condition to occur just when NOx emissions are highest and the need for EGR the greatest.

Therefore, a cost effective and reliable means for cylinder deactivation is desirable which also addresses the concerns raised with NOx emissions.

SUMMARY OF THE INVENTION

In its embodiments, the present invention contemplates a four-stroke cycle, multi-cylinder reciprocating internal combustion engine having a crankshaft and a plurality of pistons reciprocably contained within a plurality of cylinders. The engine includes at least one intake poppet valve and at least one exhaust poppet valve for each engine cylinder, and a camshaft for operating the intake valves and the exhaust valves. A camshaft phaser is coupled to the camshaft for adjusting the rotational position of the camshaft with respect to the rotational position of the crankshaft. An intake manifold, having a common plenum, is in communication with each of the intake valves, and an interconnected exhaust system receives exhaust gases from at least some cylinders which are to remain fully active and at least some of the cylinders to be deactivated. A controller is connected to the camshaft phaser for deactivating at least some of the cylinders and recirculating exhaust gas from the deactivated cylinders into the common plenum by operating the camshaft phaser so that for the cylinders which are to be deactivated, the camshaft timing is adjusted such that the intake valve and the exhaust valve open and close at points which are slightly beyond symmetrical about a rotational position of the crankshaft at which the direction of motion of the cylinder's piston changes.

The present invention further contemplates a method for operating a multi-cylinder, four-stroke cycle reciprocating internal combustion engine on fewer than the maximum number of cylinders. The method comprises the steps of: providing an intake manifold having a common plenum; providing an exhaust system connected to the cylinders; sensing a plurality of engine and vehicle operating parameters, including at least engine load and engine speed; comparing the sensed operating parameters with predetermined threshold values; issuing a fractional engine cylinder operation command in the event that the sensed parameters exceed said threshold values so as to deactivate at least one cylinder of said engine; adjusting the timing of at least one camshaft which operates poppet intake and exhaust valves of the cylinders to be deactivated so that valve lift events for both intake and exhaust valves are shifted out of phase of standard timing; and further adjusting the timing of at least one camshaft so that exhaust gas flows out past the poppet intake valve of the cylinders that are deactivated into the common plenum.

The present invention uses wide range intake and exhaust camshaft phase shifting. The system according to the present invention simply employs an actuator mechanism to phase shift the intake and exhaust camshafts equally on the cylinders to be deactivated as well as provide pumped EGR while these cylinders are deactivated. If the valves on the deactivated cylinders are controlled by a single overhead camshaft then the phase shifter is connected to the single camshaft. If the valves on the deactivated cylinders are controlled by dual overhead camshafts, one for the exhausts and one for the intake, then the phase shifter will control both camshafts equally either by providing two phase shifters, one for each camshaft, or a single phase shifter provided that, in the single phase shifter case, the two camshafts are mechanically linked together. Thus, according to the present invention, adjusting the timing of the valve lift events has no effect on the relative timing between the exhaust valve lift event and the intake valve lift event. That is, the timing between exhaust valve and intake valve lift events remains constant, regardless of phase shifting.

Further, all of the cylinders in this dual equal variable displacement engine are interconnected with a common exhaust system. Then, by retarding (or alternatively advancing) the phasing of the cam shaft of the deactivated cylinders past the position of no net flow, the flow will reverse direction and actually feed the EGR to the common plenum and consequently the firing cylinders. The phasing of the camshaft is then adjusted for more or less EGR and acts as an EGR pump supplying the necessary EGR to the firing cylinders for NOx control. This operation is especially effective when the firing cylinders are highly loaded and, even though the manifold air pressure is at high levels, EGR can still be pumped to reduce NOx emissions.

Accordingly, an object of the present invention is to provide an engine having cylinder deactivation accomplished by dual equal cam phase shifting along with pumped EGR during cylinder deactivation, with exhaust flowing from the deactivated cylinders to the active cylinders by additional cam phase shifting.

An advantage of the present invention is that the cam phase shifters used to deactivate the cylinders can be used for pumping the EGR, thus allowing for a cylinder deactivation system which operates adequately with minimal cost concerns, and minimizes NOx emissions.

Another advantage of the present invention is that exhaust gas oxygen sensors can be employed for feedback control of the EGR flow through the deactivated cylinders to precisely control the EGR in the active cylinders.

DETAILED DESCRIPTION OF THE PREFERRED EMBODIMENTS

Figure 1:
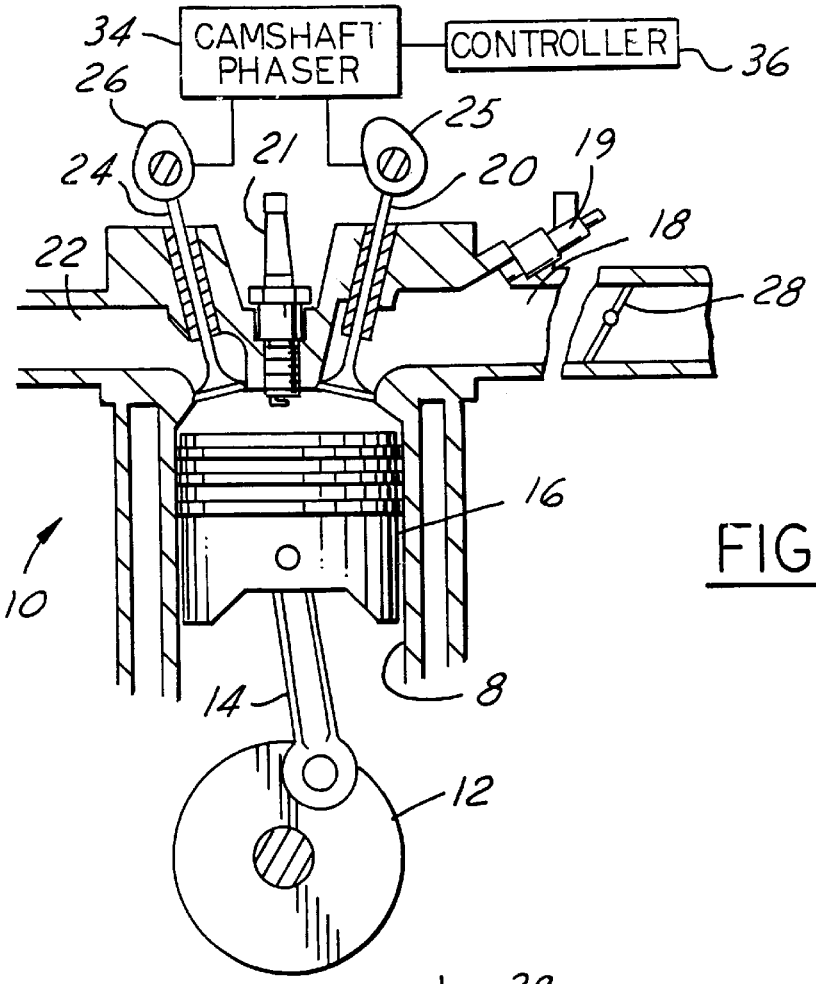
FIG. 1 is a schematic representation of an engine equipped with a cylinder deactivation system according to the present invention.

FIG. 1 illustrates one cylinder 8 of a multi-cylinder, four-stroke cycle, reciprocating, internal combustion engine 10. The engine 10 has a crankshaft 12 with a connecting rod 14 and a piston 16 located in the cylinder 8. Air that has been regulated by a plenum throttle 28, located upstream of the cylinder 8, flows into the cylinder 8 through an intake port 18 along with fuel from a fuel injector 19. The incoming flow is controlled by an intake valve 20, which is actuated by an intake camshaft 25. A spark plug 21 is employed in a conventional fashion to ignite the air/fuel mixture. Exhaust gases exit the cylinder 8 through an exhaust port 22 after flowing past an exhaust valve 24. The exhaust valve 24 is actuated by an exhaust camshaft 26. As with conventional engines of this type, ingress and egress of air into and out of the engine 10 is controlled by adjusting the timing of the intake camshaft 25 and exhaust camshaft 26, respectively.

A cam phaser 34 is connected to both camshafts 25, 26 which adjusts the relative rotational position of the camshafts 25, 26 relative to the crankshaft 12. Of course, separate camshaft phasers can be employed for both the intake camshaft 25 and exhaust camshaft 26 so long as the two can be phase shifted simultaneously. A controller 36 communicates with the cam phaser 34 to control the timing and amount of cam phase shift that takes place. One will note that FIG. 1 shows the engine 10 having a dual overhead camshaft configuration. However, as will be apparent to those skilled in the art in view of the present invention, a single overhead cam configuration may be employed instead to actuate and adjust the timing of both intake valve 20 and exhaust valve 24.

The camshafts 25, 26 rotate at half the speed of the crankshaft 12, as with a conventional four-stroke engine. Thus, as used herein, the terms "intake stroke," "exhaust stroke," "compression stroke," and "expansion stroke" are meant to refer to these conventional strokes which are known to those skilled in the art of internal combustion engines, and these strokes are referred to in a conventional fashion even when the cylinder is deactivated. This is done for the convenience of understanding the points in the cycle of engine operation wherein various events occur according to the present invention.

Figure 2:
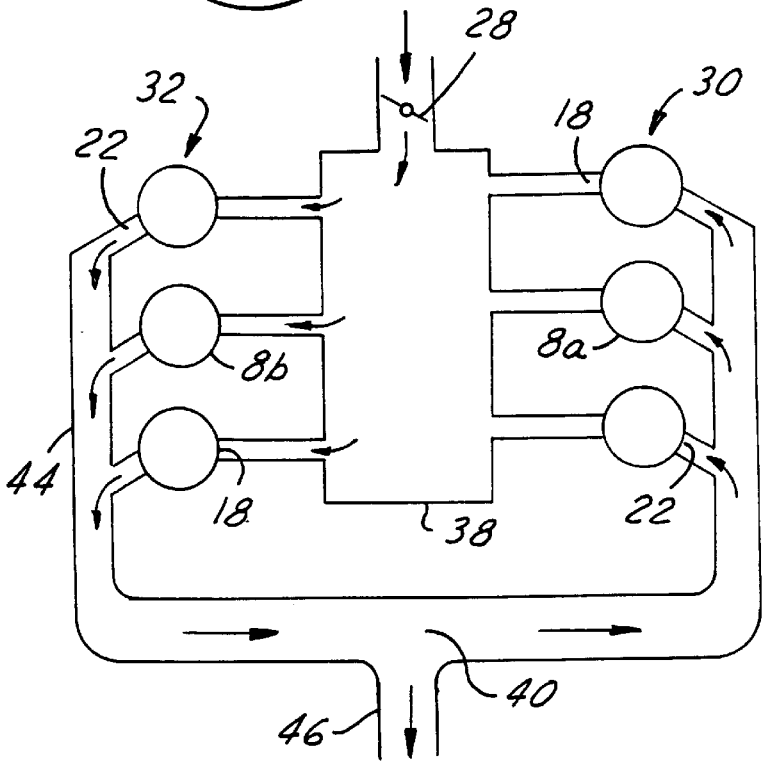
FIG. 2 is a schematic diagram of an engine according to the present invention.

FIG. 2 schematically illustrates a V6 engine configuration employing the cylinder 8 of FIG. 1. The right hand bank 30 of cylinders 8*a* are the cylinders to be deactivated while the left hand bank 32 of cylinders 8*b* are the cylinders which remain activated (i.e., firing) for all engine operating conditions. On the cylinders 8*a* to be deactivated, the camshafts 25, 26 that are retarded approximately 90° to 100° from standard timing will need to employ a wide-range phase shifter. For the left hand bank 32, while FIG. 1 illustrates a camshaft phaser, the camshaft for the left hand bank 32 may or may not have a cam phaser. The cam phaser is not needed on the left hand bank 32 for the cylinder deactivation strategy but may be employed for other engine strategy reasons known to those skilled in the art.

An intake manifold having a common intake plenum 38 feeds into the intake ports 18 through intake runner 52. With this configuration, the deactivated cylinders 8*a* experience the same manifold pressure as the firing cylinders 8*b* that are carrying the load. Thus, plenum 38 should be large enough so that the intake pulsing caused by the deactivated cylinders 8*a* will not disrupt the operation of the firing cylinders 8*b*.

An exhaust system 40 includes a right hand manifold 42 and a left hand manifold 44, which communicate with the right hand 30 and left hand 32 banks, respectively. They join together in a single runner 46 to form an interconnected exhaust.

There are many conditions in which it is desirable to operate an engine with less than the maximum number of cylinders, and, as noted above, the purpose of the present invention is to allow such fractional operation. According to the present invention, adjusting the timing of valve lift events has no effect on the relative timing between exhaust valve lift event and intake valve lift event. That is, the timing between exhaust valve and intake valve lift events remains constant, regardless of phase shifting.

In a typical control algorithm, cylinder deactivation would not be used unless engine speed exceeds a minimum threshold value and engine load is less than a minimum threshold value. In this sense, the term "exceed" is used herein to mean that the value of the sensed parameter may either be greater than or less than the threshold value. Other parameters besides engine speed and load may also be used to determine when cylinder deactivation takes place. In the event that sensed parameters exceed threshold values, the controller 36 will command the camshaft phaser 34 to adjust or shift the timing of camshafts 25, 26 which operate intake valve 20 and exhaust valve 24, respectively, to achieve the timing needed for cylinder deactivation. The exact amount of timing retard must be determined experimentally; but a controlling factor is that the intake event must be approximately centered (symmetric) about BDC and the exhaust event approximately centered about TDC. As would be apparent to one of ordinary skill in the art in view of this disclosure, the camshafts 25, 26 may also be phased about 90° advanced of standard timing to achieve the same result.

In an engine having a system according to the present invention, the atmospheric pressure which is reached on the exhaust stroke is maintained through a portion of the intake stroke until the intake valve 20 opens and the exhaust valve 24 closes. Thereafter, pressure decreases to a sub-atmospheric pressure at bottom-dead-center (BDC) of the intake stroke (the level of which is dictated by the pressure in intake manifold plenum 38) until the exhaust valve 24 closes. Then, the pressure in the cylinder 8*a* is maintained at intake manifold pressure through BDC of the intake stroke and once again increases during the compression stroke to a super-atmospheric value which is then reduced during the expansion stroke, which follows the compression stroke. The mass that is drawn into the cylinder 8*a* in the later part of the intake stroke is pushed back out during the first part of the compression stroke. The mass that is pushed out of the cylinder 8*a* in the later part of the exhaust stroke is drawn back in during the first part of the intake stroke. Thus, there is no net mass flow through the deactivated cylinders, thereby eliminating the need for any dedicated throttle, throttle controller or flow shut off valve for the deactivated cylinders 8*a*.

Because the pressure buildup from sub-atmospheric to atmospheric, which occurs as the piston 16 moves from BDC to top-dead-center (TDC) on the exhaust stroke is reduced to the same sub-atmospheric pressure during the subsequent expansion to BDC on the intake stroke, the net effect is that the work required to compress the gases within the cylinder 8*a* is extracted during expansion of the intake stroke, and as a result, very little energy is dissipated within the engine cylinder 8*a*. This prevents pumping losses which would occur if air were drawn through the intake system during the period in which the cylinders 8*a* are deactivated. Those skilled in the art will appreciate in view of this disclosure that a variety of camshaft phaser mechanisms could be employed for the purpose of providing the camshaft phaser 34. For example, U.S. Pat. No. 5,107,804 discloses but one of a plurality of camshaft phaser mechanisms which could be employed in a system according to the present invention. Such a system and method are disclosed in U.S. patent application Ser. No. 08/543,744, incorporated herein by reference.

The description of the present invention up to this point, describes the means for cylinder deactivation, but does not address the concern with NOx emissions. For this, the controller 36 further actuates the cam phaser 34, to phase shift slightly beyond the point at which the no-net-flow condition is reached for cylinder deactivation. The right hand bank of cylinders 30, are now not only deactivated, but acts as an EGR pump supplying EGR gasses to the firing left hand bank of cylinders 32. The backflow occurs during the valve overlap period which occurs part way through the intake stroke. The arrows in FIG. 2 illustrate the flow of gasses when the right hand bank 30 is deactivated and then phase shifted slightly farther.

By adjusting the camshaft phasing for increased retard (or advance as the case may be), the deactivated cylinders 8*a* now pull some exhaust gasses up through the right hand manifold 42 from the left hand manifold 44 that otherwise would flow out with the rest of the exhaust produced by the firing cylinders 8*b* into joined runner 46. This exhaust gas in the deactivated cylinders 8*a* will be pumped into the common intake plenum 38 and mix with incoming air received through the plenum throttle 28 before entering the firing cylinders 8*b*. The amount of phase shift beyond the no-net-flow condition, of course, will depend upon the desired amount of EGR required for NOx reductions, although generally, a further phase shift of up to about 20 crank degrees beyond the no-net-flow condition is believed sufficient for the EGR quantities required.

The embodiment discussed above relates to a V6 engine. However, those skilled in the art will appreciate in view of this disclosure that a system according to this invention could be used in a V6 or V12 engine, or, for that matter, a V8 engine if the V8 engine is equipped with a co-planar crankshaft.

Figure 3:
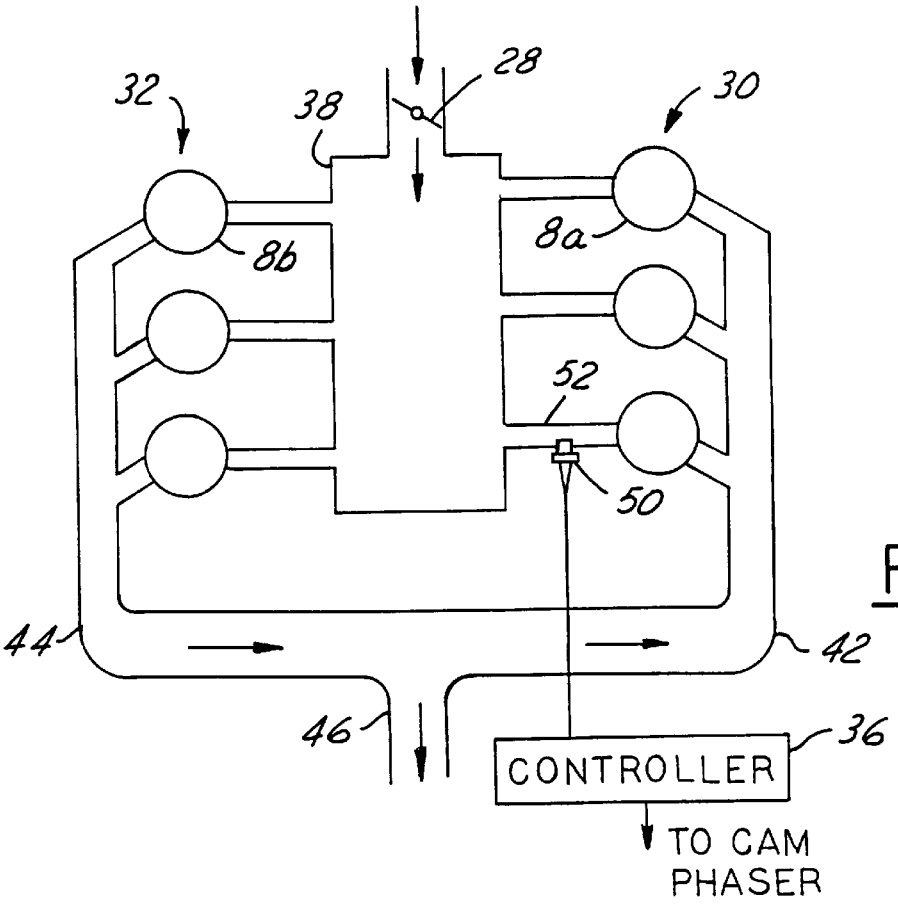
FIG. 3 is a schematic diagram similar to FIG. 2, illustrating an alternate embodiment according to the present invention.

FIG. 3 illustrates a second embodiment of the present invention. This embodiment allows a more precise determination of the amount of cam retard (or alternatively advance) that is needed in order to produce the desired amount of EGR flow for the cylinder deactivation mode. In the first embodiment, the amount of EGR recirculation pumped by the deactivated cylinders 8*a* is experimentally determined for a given amount of camshaft retard. Then, this amount of retard is presumed correct during engine operation. While this may be adequate for some applications, the need may arise for a more accurate control of the actual EGR flow.

A heated exhaust gas oxygen (HEGO) sensor 50 is placed in an intake manifold runner 52 of one of the deactivated cylinders 8*a*, and is in communication with the controller 36. A HEGO sensor is typically used on conventional gasoline engines as a device to maintain a stoichiometric air/fuel ratio. Its output voltage switches as a function of oxygen concentration (equivalence ratio) when going from either rich or lean through stoichiometry.

While operating at part load (i.e., with one bank of cylinders deactivated) at stoichiometric Air/Fuel ratio (equivalence ratio equal to one) the HEGO sensor 50 switches when exhaust gas starts to flow from the deactivated cylinder 8*a* into the intake manifold 38. It will thus indicate when cam phasing is retarded past the no-net-flow condition and starts to pump EGR (stoichiometric exhaust gas) into the intake runner 52. At that point, the controller 36 will adjust the cam to a calibrated predetermined setting relative to the no-net-flow condition that will pump the desired amount of EGR to the firing cylinders 8*b*. By knowing exactly when the no-net-flow condition is reached due to cam phasing, a more accurate flow control is possible.

Figure 4:
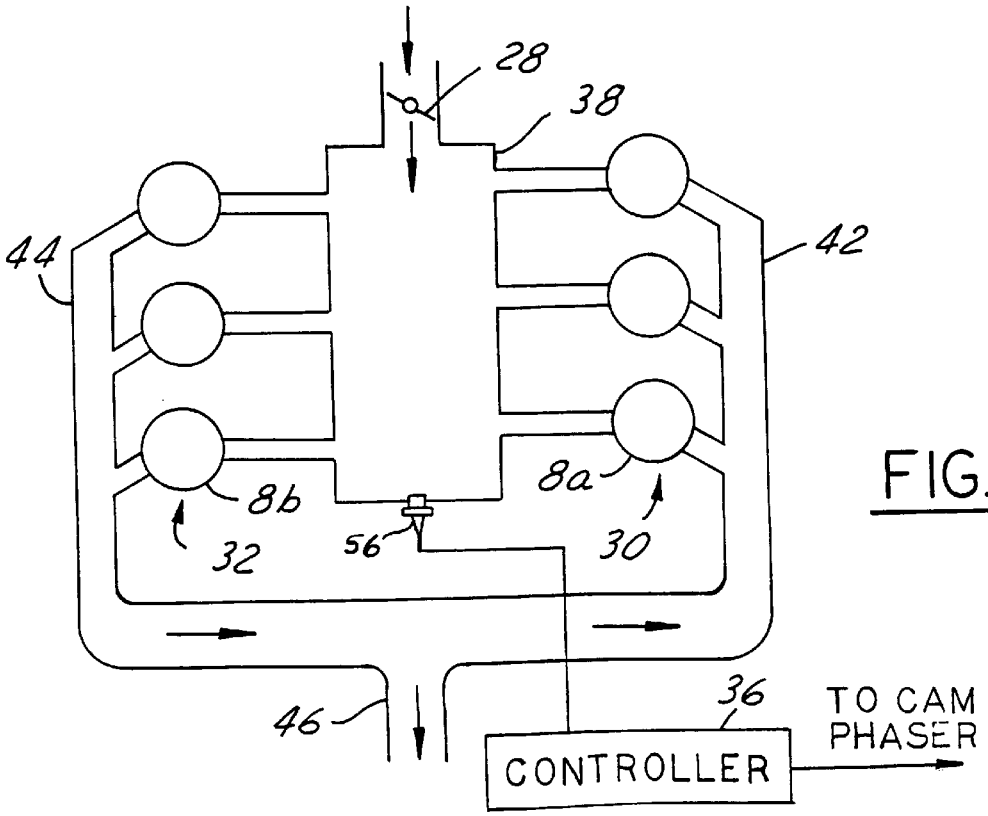
FIG. 4 is a schematic diagram similar to FIG. 2, illustrating a third embodiment according to the present invention.

FIG. 4 illustrates a third embodiment of the present invention. Another configuration for feedback control of the EGR rate that can be used, not only for stoichiometric engine operation, but also for lean engine operation, is to locate a universal exhaust gas oxygen (UEGO) sensor 56 in the intake manifold plenum 38. A UEGO has a linear output as a function of oxygen concentration (equivalence ratio). As the camshaft for the deactivated bank of cylinders 30 is retarded past the position of no-net-flow and EGR gas begins to pump into the intake manifold 38, the UEGO sensor 56 will measure the oxygen concentration (equivalence ratio) of the mixture, providing a closed loop system for controlling the exact amount of EGR required for the firing cylinders 8*b*. This measured concentration (equivalence ratio) is a function of the air/fuel ratio of the firing cylinders 8*b* (known from the engine calibration for the desired lean or rich air/fuel ratio) and the amount of dilution of the EGR/fresh air mixture required. The cam phaser is then adjusted by the controller 36 to produce the desired amount of EGR dilution.

While the invention has been shown and described in its preferred embodiments, it will be clear to those skilled in the arts to which it pertains that many changes and modifications may be made thereto without departing from the scope of the invention.

We claim:

1. A four-stroke cycle, multi-cylinder reciprocating internal combustion engine having a crankshaft and a plurality of pistons reciprocably contained within a plurality of cylinders, said engine comprising:

at least one intake poppet valve and at least one exhaust poppet valve for each engine cylinder;

a first camshaft for operating some of the intake valves and a second camshaft for operating some of the exhaust valves, with the two camshafts mechanically linked together;

a camshaft phaser coupled to at least one of the first and second camshafts for simultaneously adjusting the rotational position of the first and second camshafts with respect to the rotational position of the crankshaft;

an intake manifold having a common plenum in communication with each of the intake valves;

an interconnected exhaust system for receiving exhaust gases from at least some cylinders which are to remain fully active and at least some of the cylinders to be deactivated; and a controller, connected to the camshaft phaser, for deactivating at least some of the cylinders and recirculating exhaust gas from the deactivated cylinders into the common plenum by operating the camshaft phaser so that for the cylinders which are to be deactivated, the camshaft timing is adjusted such that the intake valve and the exhaust valve open and close at points which are slightly beyond approximately symmetrical about a rotational position of the crankshaft at which the direction of motion of the cylinder's piston changes.

2. The engine of claim 1 wherein intake manifold runners extend from the common plenum to each of the cylinders, and wherein the engine further includes an exhaust gas oxygen sensor mounted in one of the intake manifold runners for one of the cylinders that is deactivatable, with the sensor operatively engaging the controller.

3. The engine of claim 2 wherein the exhaust gas oxygen sensor is a heated exhaust gas oxygen sensor.

4. The engine of claim 1 further including an exhaust gas oxygen sensor mounted in the common plenum and operatively engaging the controller.

5. The engine of claim 4 wherein the exhaust gas oxygen sensor is a universal exhaust gas oxygen sensor.

6. The engine of claim 1 wherein the controller operates said camshaft phaser such that the camshafts are retarded substantially more than 90° out of phase of standard timing.

7. The engine of claim 1 wherein the controller operates the camshaft phaser such that the camshafts are advanced substantially more than 90° out of phase of standard timing.

8. The engine of claim 1 wherein the engine is a v-type having two banks of cylinders, with each of the banks having a separate intake and exhaust camshaft and an associated camshaft phaser, with the controller operating the camshaft phaser of one of the banks of cylinders such that all of the cylinders of such bank are deactivated and all of the cylinders of such bank return exhaust gas to the intake manifold.

9. A method for operating a multi-cylinder, four-stroke cycle reciprocating internal combustion engine on fewer than the maximum number of cylinders, comprising the steps of:

providing an intake manifold having a common plenum;

providing an exhaust system connected to the cylinders;

sensing a plurality of engine and vehicle operating parameters, including at least engine load and engine speed;

comparing the sensed operating parameters with predetermined threshold values;

issuing a fractional engine cylinder operation command in the event that the sensed parameters exceed said threshold values so as to deactivate at least one cylinder of said engine;

adjusting the timing of at least one camshaft which operates poppet intake and exhaust valves of the cylinders to be deactivated so that valve lift events for both intake and exhaust valves are shifted out of phase of standard timing;

providing an exhaust gas oxygen sensor in the common plenum;

monitoring an equivalence ratio in the common plenum with the exhaust gas oxygen sensor;

comparing the sensed equivalence ratio with a desired equivalence ratio; and adjusting the timing of the at least one camshaft based on the comparison of the sensed and desired equivalence ratios so that an desired amount of exhaust gas flows out past the poppet intake valve of the cylinders that are deactivated into the common plenum.

10. The method of claim 9 wherein the adjusting step comprises the step of retarding intake and exhaust valve lift substantially more than 90° out of phase of standard timing.

11. The method of claim 10 wherein the further adjusting step comprises retarding the timing of the at least one camshaft up to an additional 20°.

12. The method of claim 9 wherein the adjusting step comprises the step of advancing intake and exhaust valve lift substantially more than 90° out of phase of standard timing.

13. A method for operating a multi-cylinder, four-stroke cycle reciprocating internal combustion engine on fewer than the maximum number of cylinders, comprising the steps of:

providing an intake manifold having a common plenum and intake manifold runners between the common plenum and each of the cylinders;

providing an exhaust system connected to the cylinders;

sensing a plurality of engine and vehicle operating parameters, including at least engine load and engine speed;

comparing the sensed operating parameters with predetermined threshold values;

issuing a fractional engine cylinder operation command in the event that the sensed parameters exceed said threshold values so as to deactivate at least one cylinder of said engine;

adjusting the timing of at least one camshaft which operates poppet intake and exhaust valves of the cylinders to be deactivated so that valve lift events for both intake and exhaust valves are shifted out of phase of standard timing;

providing an exhaust gas oxygen sensor in one of an intake manifold runners of one of the cylinders to be deactivated;

monitoring the equivalence ratio in one of the intake manifold runners of one of the cylinders to be deactivated with the exhaust gas oxygen sensor;

comparing the sensed equivalence ratio with a desired equivalence ratio; and adjusting the timing of the at least one camshaft based on the comparison of the sensed and desired equivalence ratios so that the desired amount of exhaust gas flows out past the poppet intake valve of the cylinders that are deactivated into the common plenum.

* * * * *